US011303053B2

(12) United States Patent
Tanaka et al.

(10) Patent No.: US 11,303,053 B2
(45) **Date of Patent: *Apr. 12, 2022**

(54) CONNECTOR ASSEMBLY

(71) Applicant: JAPAN AVIATION ELECTRONICS INDUSTRY, LIMITED, Tokyo (JP)

(72) Inventors: Yukitaka Tanaka, Tokyo (JP); Yuki Suda, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/063,769

(22) Filed: Oct. 6, 2020

(65) Prior Publication Data

US 2021/0167535 A1 Jun. 3, 2021

(30) Foreign Application Priority Data

Dec. 3, 2019 (JP) ..... JP2019-218489

(51) Int. Cl.
*H01R 12/79* (2011.01)
*H01R 12/77* (2011.01)

(52) U.S. Cl.
CPC ..... *H01R 12/79* (2013.01); *H01R 12/775* (2013.01)

(58) Field of Classification Search
CPC .. H01B 7/0869; H01B 7/0861; H01B 7/0838; H01R 13/6582; H01R 12/594; H01R 12/775; H01R 12/79; H01R 12/59
See application file for complete search history.

(56) References Cited

U.S. PATENT DOCUMENTS 5,679,008 A 10/1997 Takahashi et al.
6,489,563 B1 * 12/2002 Zhao ..... H01R 9/0524 174/88 C
7,399,929 B2 7/2008 Ueno et al.
8,221,147 B2 7/2012 Ozeki
9,356,403 B1 * 5/2016 Hsu ..... G11B 33/122
(Continued)

FOREIGN PATENT DOCUMENTS

CN 202076032 U 12/2011
CN 101888034 B 2/2013
CN 104852191 B 5/2017
CN 107799930 B 9/2019
JP 2010010107 A 1/2010
(Continued)

OTHER PUBLICATIONS

Taiwanese Office Action dated Jul. 8, 2021 (and English translation thereof) issued in Taiwanese Application No. 11020655490.
(Continued)

*Primary Examiner* — Jean F Duverne
(74) *Attorney, Agent, or Firm* — Holtz, Holtz & Volek PC

(57) ABSTRACT

A connector assembly comprises a connector and a mating connector. The connector is attachable with a connecting object having a sheet-like shape. The connecting object has a wiring layer, a conductive layer and an insulator. The wiring layer includes at least one trace. The trace has a first contact portion. The conductive layer has at least two second contact portions. The connector is mateable with the mating connector along a first direction. The mating connector comprises at least one mating first terminal and at least two mating second terminals. Under a mated state where the connector in the attached state is mated with the mating connector, the first contact portion is positioned between two of the mating second terminals in a second direction perpendicular to the first direction. The second contact portions are brought into contact with the mating second terminals, respectively, under the mated state.

9 Claims, 9 Drawing Sheets

(56) References Cited

U.S. PATENT DOCUMENTS

| | | | | |
|---|---|---|---|---|
| 2009/0101408 | A1* | 4/2009 | Koyama | H01R 9/0506 174/72 A |
| 2010/0055973 | A1* | 3/2010 | Yang | H01R 13/717 439/490 |
| 2011/0223777 | A1 | 9/2011 | Ikari et al. | |
| 2015/0207274 | A1* | 7/2015 | Wu | H01R 13/6597 439/867 |
| 2017/0373414 | A1 | 12/2017 | Sunada | |
| 2018/0076551 | A1* | 3/2018 | Matsuyama | H01R 12/775 |
| 2019/0190208 | A1 | 6/2019 | Muro | |
| 2021/0166834 | A1* | 6/2021 | Tanaka | H01R 13/6582 |

FOREIGN PATENT DOCUMENTS

| | | | |
|---|---|---|---|
| JP | 4526115 | B2 | 6/2010 |
| JP | 5826500 | B2 | 10/2015 |
| JP | 2017188307 | A | 10/2017 |
| TW | I621309 | B | 4/2018 |
| TW | 201946071 | A | 12/2019 |

OTHER PUBLICATIONS

Office Action (Non-Final Rejection) dated Sep. 2, 2021, issued in U.S. Appl. No. 17/061,689.

U.S. Appl. No. 17/061,689; First Named Inventor: Yukitaka Tanaka; Title: "Connecting Object, Connector and Harness"; filed Oct. 2, 2020.

Taiwanese Office Action (and English language translation thereof) dated Jul. 13, 2021, issued in Taiwanese Application No. 109135666 (which is a counterpart of U.S. Appl. No. 17/061,689).

* cited by examiner

CONNECTOR ASSEMBLY

CROSS REFERENCE TO RELATED APPLICATIONS

This application is based on and claims priority under 35 U.S.C. § 119 to Japanese Patent Application No. JP2019-218489 filed Dec. 3, 2019, the contents of which are incorporated herein in their entirety by reference.

BACKGROUND OF THE INVENTION

This invention relates to a connector assembly comprising a connector and a mating connector.

It is known that, if a wiring layer of a connecting object such as an FFC (Flexible Flat Cable) is provided with a coplanar transmission line which has two ground lines and one signal line or two signal lines which is/are arranged between the ground lines, the connecting object has a common problem that the coplanar transmission line resonates due to multiple reflection. The resonance might degrade transmission quality. Accordingly, the resonance must be prevented from occurring within a frequency band of transmitted signals. One way of preventing the resonance from occurring is to connect ground lines with each other to be commonly grounded so that a resonant frequency is shifted to a frequency which is higher than a frequency band of transmitted signals. It is known that specific means of connecting ground lines with each other is to connect a ground plane or shield layer with ground lines so that the ground lines are connected with each other via the ground plane or shield layer. An FFC, whose ground lines are connected with each other, is disclosed in, for example, JPB4526115 (Patent Document 1).

As shown in FIG. 18, an FFC 900 of Patent Document 1 has conductors 910, or ground lines 910, two conductors 920, or signal lines 920, a shield member 930, or a shield layer 930, a conductive adhesive layer 940 and an insulating member 950, or an insulator 950. The two signal lines 920 are arranged between the ground lines 910. The ground line 910 and the shield layer 930 are connected with each other by the conductive adhesive layer 940. Thus, the ground lines 910 are connected with each other via the conductive adhesive layer 940 and the shield layer 930.

The FFC 900 of Patent Document 1 has a drawback as follows. A process of manufacturing the FFC 900 is complicated so that a cost of manufacturing the FFC 900 is increased.

SUMMARY OF THE INVENTION

It is therefore an object of the present invention to provide a connector assembly comprising a connector and a mating connector, wherein: the connector is attachable with a connecting object which can prevent resonance caused by multiple reflection and which can be manufactured in a simplified process; and the mating connector is mateable with the connector.

The present invention solves the aforementioned problem in a way different from that of the FFC 900 of Patent Document 1. Specifically, a connector assembly of the present invention is configured as follows: a transmission line of a connecting object is configured as a microstrip transmission line or strip transmission line by omitting ground lines from the connecting object; and a shield layer of the connecting object is connected with a mating ground terminal of a mating connector when a connector attached with the connecting object is mated with the mating connector.

One aspect of the present invention provides a connector assembly comprising a connector and a mating connector. The connector is attachable with a connecting object having a sheet-like shape. The connecting object has a wiring layer, a conductive layer and an insulator. The wiring layer includes at least one trace. The trace has a first contact portion. The conductive layer covers the wiring layer via the insulator which is positioned between the conductive layer and the wiring layer. The conductive layer has at least two second contact portions. The connector is mateable with the mating connector along a first direction. The connector comprises a holding member. The holding member partially holds the connecting object under an attached state where the connector is attached with the connecting object. Each of the first contact portion and the second contact portions is exposed to the outside of the holding member under the attached state. The mating connector comprises at least one mating first terminal and at least two mating second terminals. Under a mated state where the connector in the attached state is mated with the mating connector, the first contact portion is positioned between two of the mating second terminals in a second direction perpendicular to the first direction. The first contact portion is brought into contact with the mating first terminal under the mated state. The second contact portions are brought into contact with the mating second terminals, respectively, under the mated state.

The connector assembly of the present invention is configured as follows: the connecting object has the shield layer; the mating connector comprises the at least two mating ground terminals; the shield layer has the at least two shield contact portions; the shield contact portion is exposed to the outside of the connecting object; and the shield contact portions are brought into contact with the mating ground terminals, respectively, under the mated state where the connector attached with the connecting object is mated with the mating connector. Accordingly, in the connector assembly of the present invention, the shield layer of the connecting object, whose transmission line is configured as a microstrip transmission line or strip transmission line, is connected with the mating ground terminal under the mated state where the connector attached with the connecting object is mated with the mating connector. Thus, the connector assembly of the present invention can prevent resonance caused by multiple reflection.

An appreciation of the objectives of the present invention and a more complete understanding of its structure may be had by studying the following description of the preferred embodiment and by referring to the accompanying drawings.

Figure 1:
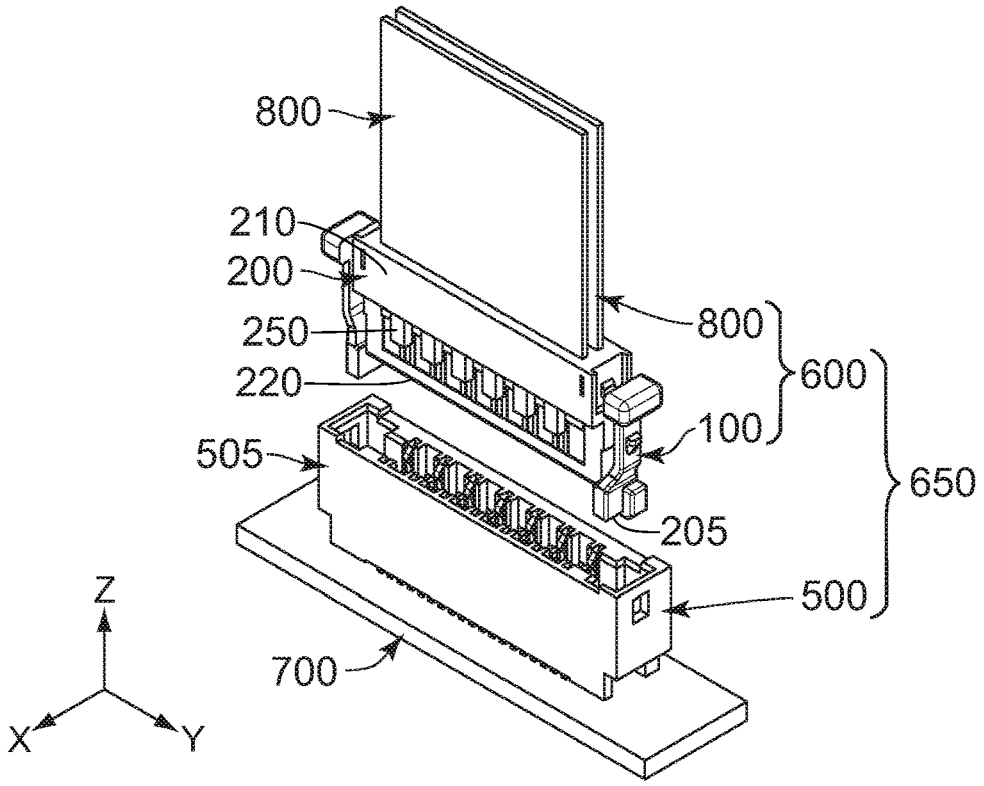
FIG. 1 is a perspective view showing a connector assembly according to an embodiment of the present invention. In the figure, a connector of a harness is in an unmated state where the connector is unmated with a mating connector, the mating connector is fixed on a circuit board, and upper parts of a wiring layer and a shield layer of a connecting object are omitted.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector assembly 650 according to an embodiment of the present invention comprises a mating connector 500 and a harness 600.

Figure 10:
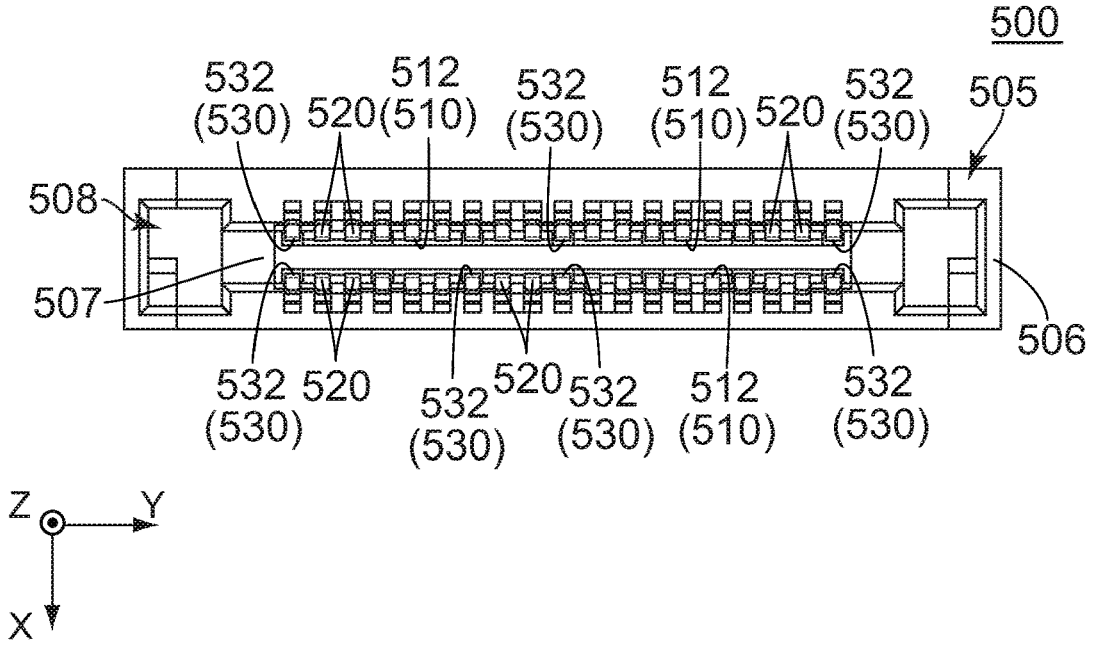
FIG. 10 is a top view showing the mating connector of FIG. 9.

As shown in FIG. 1, the mating connector 500 of the present embodiment is fixed on a circuit board 700 when used. The mating connector 500 of the present embodiment is a straight connector. As shown in FIG. 10, the mating connector 500 comprises a mating holding member 505, a plurality of mating signal terminals 510 and a plurality of mating ground terminals 530. However, the present invention is not limited thereto. The mating connector 500 should comprises at least one mating signal terminal 510 and at least two mating ground terminals 530. In the present application, the mating signal terminal 510 is also referred to as a mating first terminal, and the mating ground terminal 530 is also referred to as a mating second terminal.

Figure 11:
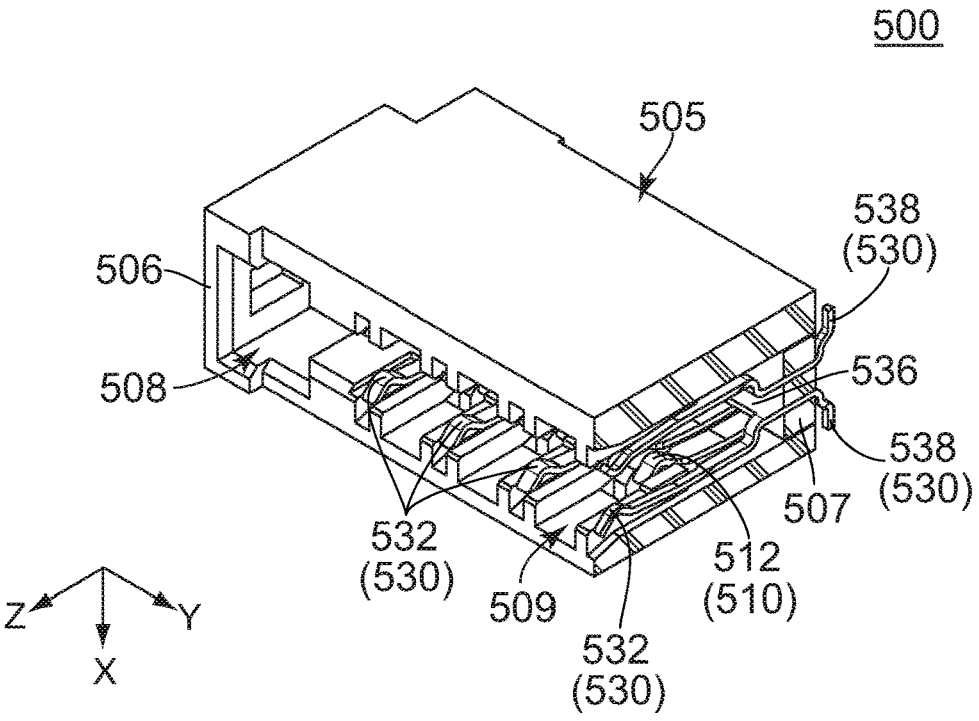
FIG. 11 is a partially cutaway cross-sectional, perspective view showing the mating connector of FIG. 9.

Referring to FIG. 11, the mating holding member 505 of the present embodiment is made of insulator. Specifically, the mating holding member 505 has a surrounding portion 506, a bottom portion 507, a mating portion accommodating portion 508 and a plurality of cover portion accommodating portions 509.

Figure 9:
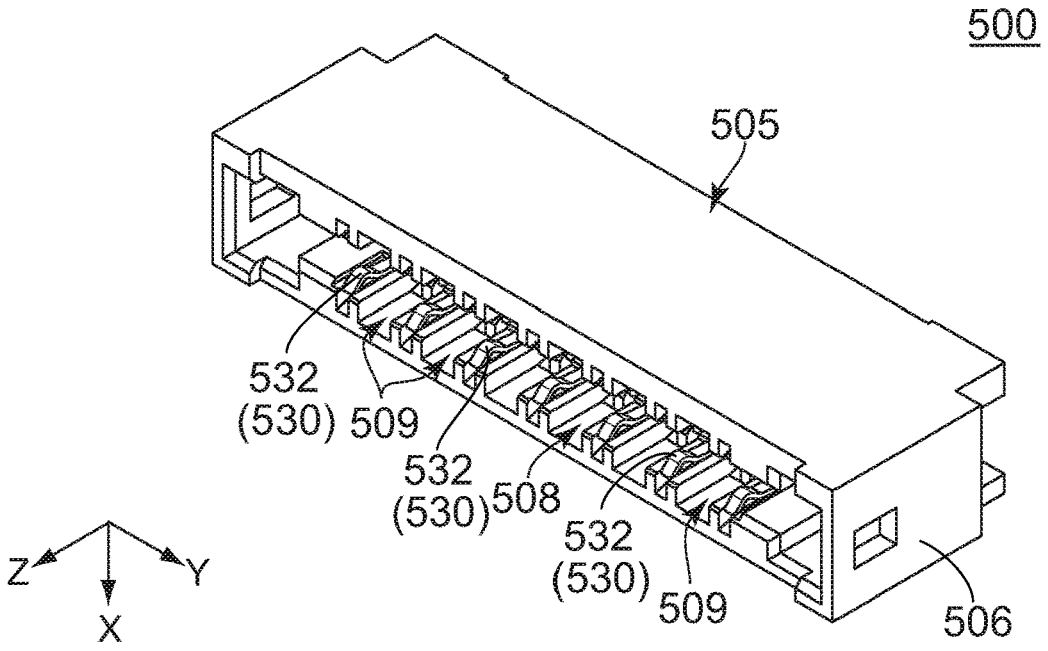
FIG. 9 is a perspective view showing the mating connector which is included in the connector assembly of FIG. 1.

As shown in FIG. 9, the surrounding portion 506 of the present embodiment has a rectangular tube shape extending in a first direction. An upper end of the surrounding portion 506 is an upper end of the mating connector 500. In the present embodiment, the first direction is a Z-direction. In the present embodiment, the first direction is also referred to as an up-down direction. Specifically, upward is a positive Z-direction while downward is a negative Z-direction. The circuit board 700 of the present embodiment is perpendicular to the first direction. In other words, The circuit board 700 is perpendicular to the up-down direction.

Figure 12:
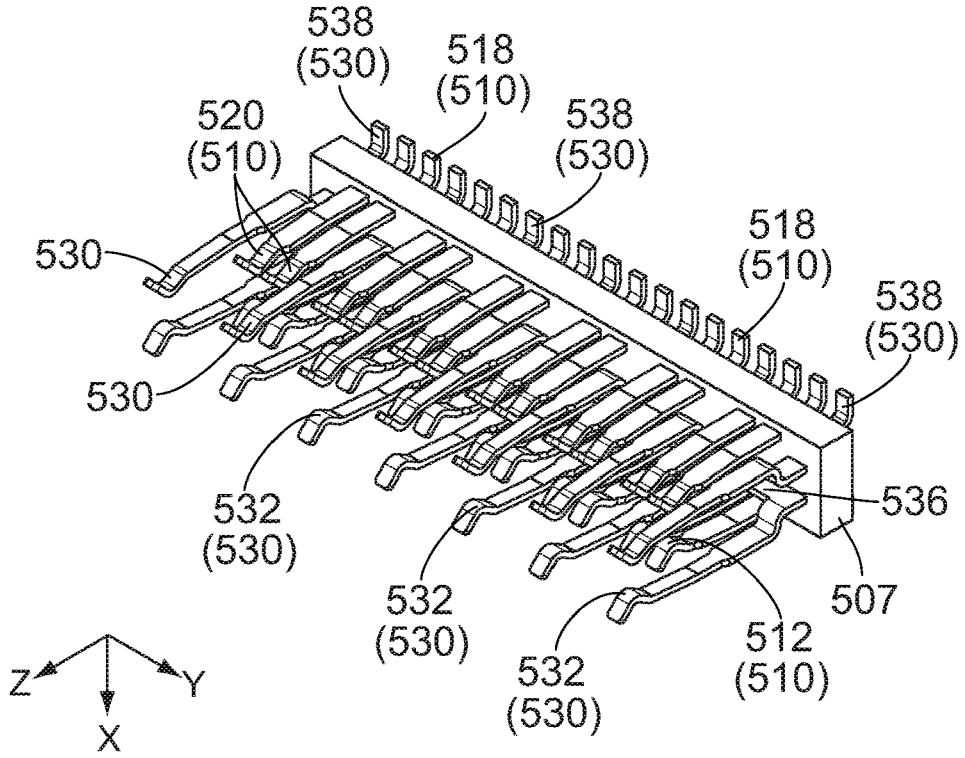
FIG. 12 is another perspective view showing the mating connector of FIG. 9. In the figure, a part of a mating holding member is omitted.
Figure 13:
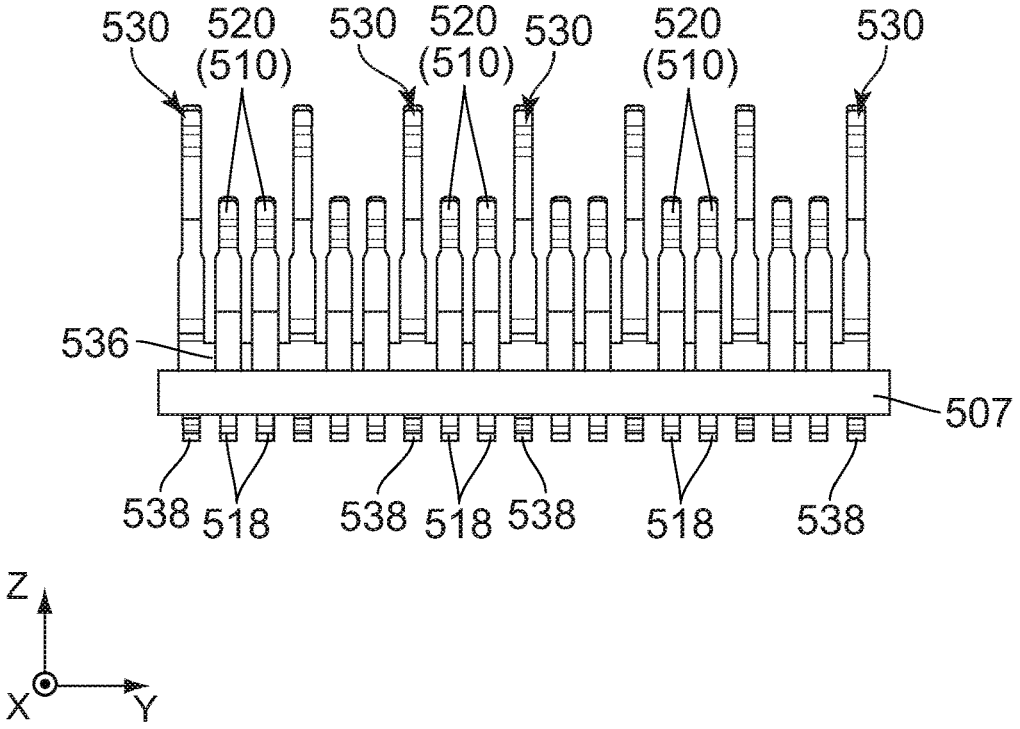
FIG. 13 is a front view showing the mating connector of FIG. 12.

As shown in FIG. 12, the bottom portion 507 of the present embodiment has a flat-plate shape perpendicular to the first direction. As shown in FIG. 11, the bottom portion 507 is positioned at a lower end of the surrounding portion 506 in the first direction.

Referring to FIG. 9, the mating portion accommodating portion 508 of the present embodiment is a space extending in the first direction. The mating portion accommodating portion 508 is surrounded by the surrounding portion 506 in a direction perpendicular to the first direction. As shown in FIG. 11, the mating portion accommodating portion 508 is positioned above the bottom portion 507 in the first direction.

As shown in FIG. 11, each of the cover portion accommodating portions 509 of the present embodiment is a space extending in the first direction. The cover portion accommodating portion 509 is surrounded by the surrounding portion 506 in the direction perpendicular to the first direction. The cover portion accommodating portion 509 is positioned above the bottom portion 507 in the first direction. The cover portion accommodating portion 509 is positioned between two of the mating ground terminals 530 in a second direction. In the present embodiment, the second direction is a Y-direction. The cover portion accommodating portion 509 is positioned above the mating signal terminal 510 in the first direction.

Figure 4:
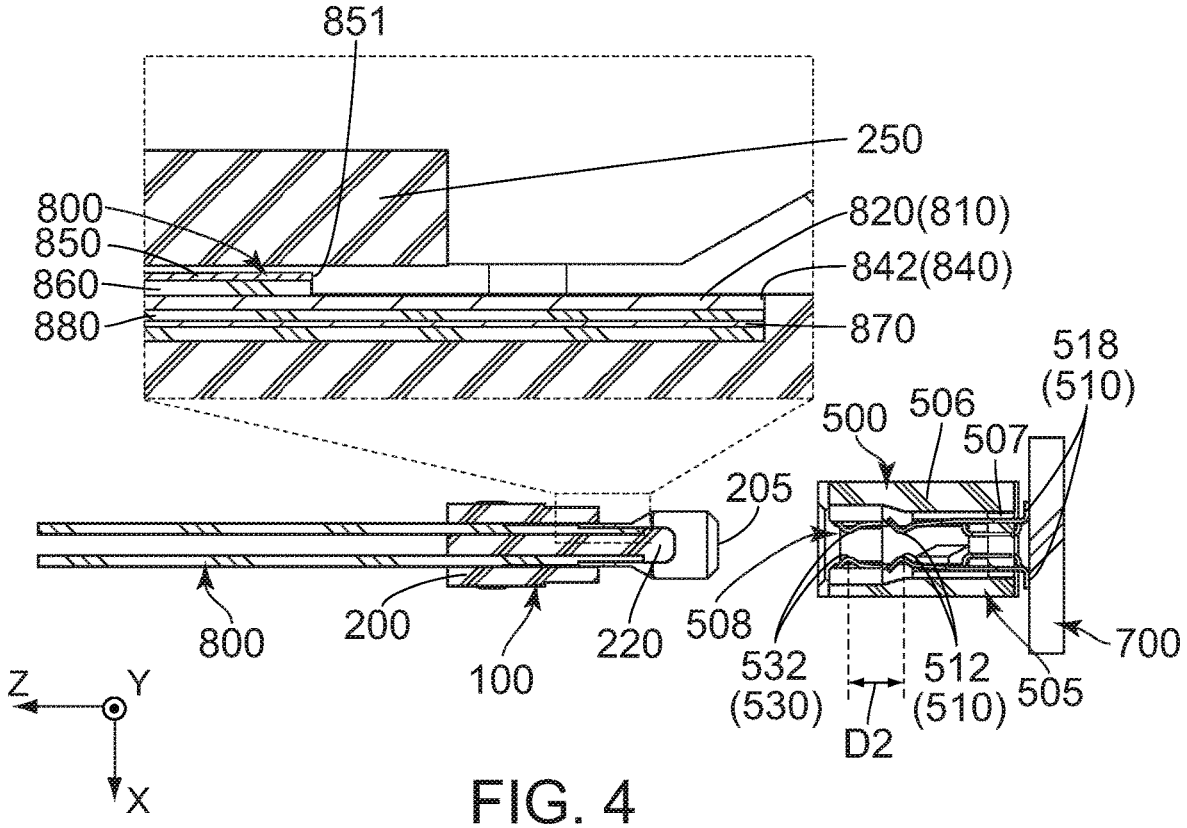
FIG. 4 is a cross-sectional view showing the connector assembly of FIG. 2, taken along line B-B.

As shown in FIGS. 4 and 12, each of the mating signal terminals 510 of the present embodiment is a terminal for surface mount technology (SMT). Specifically, each of the mating signal terminals 510 is configured to be fixed on a surface of the circuit board 700 by soldering or the like. Referring to FIG. 12, each of the mating signal terminals 510 is made of metal. The mating signal terminals 510 have the same shape as each other. As shown in FIG. 4, the mating signal terminals 510 are held by the mating holding member 505. More specifically, the mating signal terminals 510 are held by the bottom portion 507. As shown in FIG. 10, the mating signal terminals 510 are arranged in two rows. The mating signal terminals 510 of each of the two rows are arranged in the second direction. The mating signal terminals 510 of one of the two rows face the mating signal terminals 510 of a remaining one of the two rows in a third direction. In the present embodiment, the third direction is an X-direction. The mating signal terminals 510 include a plurality of differential pairs 520 each of which consists of two of the mating signal terminals 510. However, the present invention is not limited thereto. The mating signal terminals 510 may include the mating signal terminals 510 consisting the differential pair 520 or may be terminals for single-ended transmission. Referring to FIGS. 11 and 12, the differential pairs 520 correspond to the cover portion accommodating portions 509, respectively. Each of the differential pairs 520 is positioned below the cover portion accommodating portion 509 corresponding thereto in the first direction.

As shown in FIG. 12, each of the mating signal terminals 510 has a contact point 512 and a fixed portion 518.

As shown in FIG. 10, the contact point 512 of the present embodiment protrudes in the mating portion accommodating portion 508.

As shown in FIG. 4, the fixed portion 518 of the present embodiment is fixed on a pad (not shown) of the circuit board 700 when the mating connector 500 is mounted on the circuit board 700. The fixed portion 518 defines a lower end of the mating signal terminal 510. The fixed portion 518 extends outward in the third direction.

Figure 3:
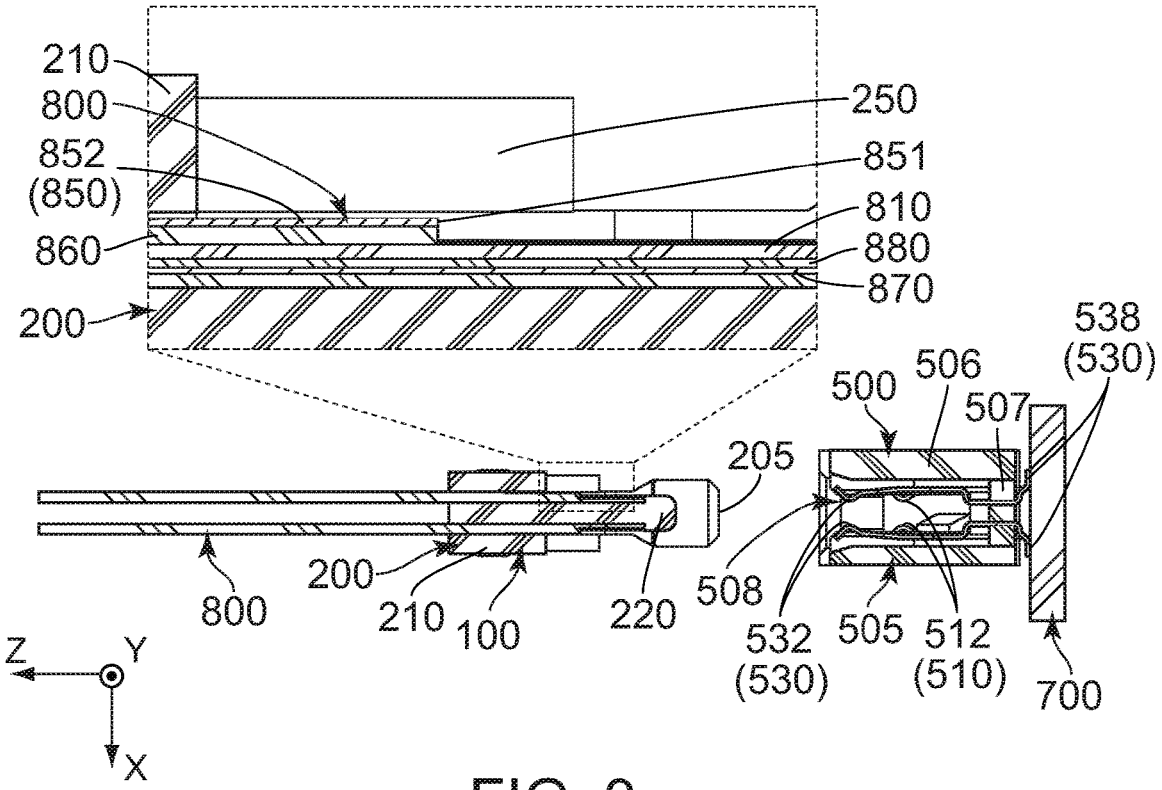
FIG. 3 is a cross-sectional view showing the connector assembly of FIG. 2, taken along line A-A.
Figure 14:
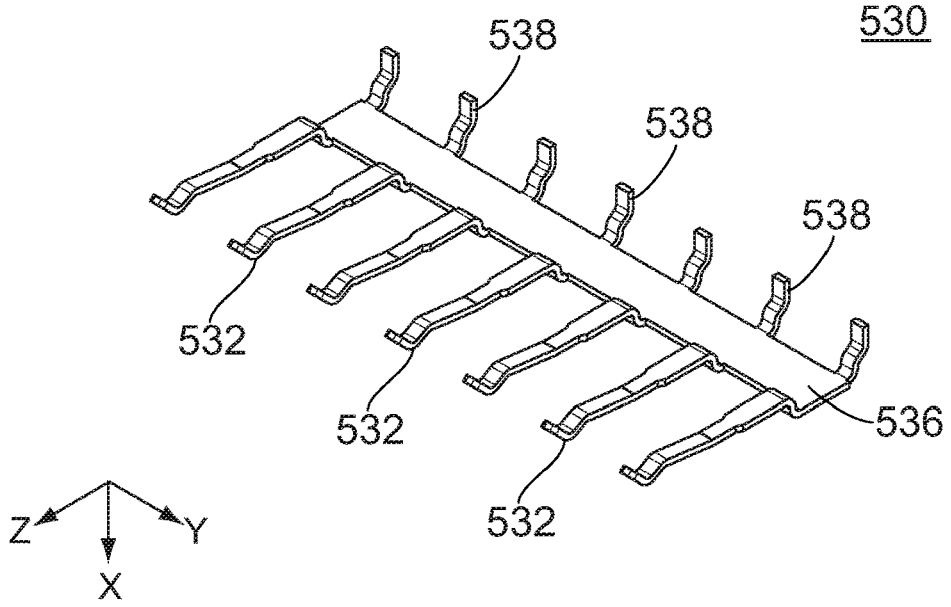
FIG. 14 is a perspective view showing mating ground terminals which are included in the mating connector of FIG. 9.
Figure 15:
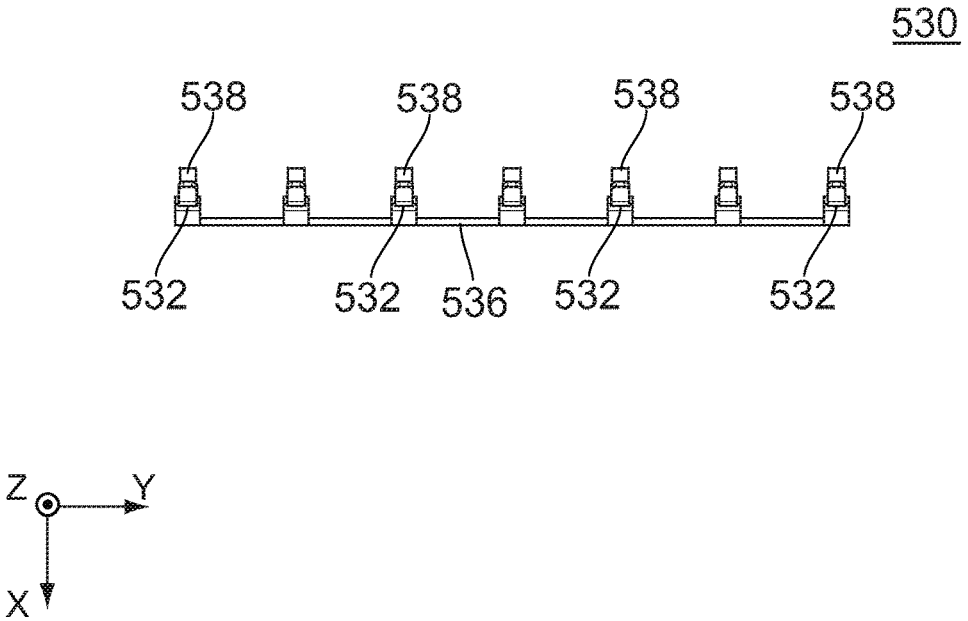
FIG. 15 is a top view showing the mating ground terminals of FIG. 14.

As shown in FIGS. 3 and 14, each of the mating ground terminals 530 of the present embodiment is a terminal for SMT. Specifically, each of the mating ground terminals 530 is configured to be fixed on the surface of the circuit board 700 by soldering or the like. Referring to FIG. 14, each of the mating ground terminals 530 is made of metal. The mating ground terminals 530 have the same shape as each other. As shown in FIG. 12, the mating ground terminal 530 has a shape different from a shape of the mating signal terminal 510. In the first direction, the mating ground terminal 530 has a size greater than a size of the mating signal terminal 510. As shown in FIG. 10, the mating ground terminals 530 are arranged in two rows. The mating ground terminals 530 of each of the two rows are arranged in the second direction. The mating ground terminals 530 of one of the two rows face the mating ground terminals 530 of a remaining one of the two rows in the third direction. The mating ground terminals 530 are arranged so that the two mating signal terminals 510 of each of the differential pairs 520 are put between the mating ground terminals 530 in the second direction. As shown in FIG. 11, the mating ground terminals 530 are held by the mating holding member 505. More specifically, the mating ground terminals 530 are held by the bottom portion 507.

As shown in FIG. 14, each of the mating ground terminals 530 has a contact point 532 and a fixed portions 538.

As shown in FIG. 10, the contact point 532 of the present embodiment protrudes in the mating portion accommodating portion 508. As shown in FIG. 12, the contact point 532 of the mating ground terminal 530 is positioned above the contact point 512 of the mating signal terminal 510 in the first direction.

Referring to FIG. 3, the fixed portion 538 of the present embodiment is fixed on a pad (not shown) of the circuit board 700 when the mating connector 500 is mounted on the circuit board 700. The fixed portion 538 defines a lower end of the mating ground terminal 530. The fixed portion 538 extends outward in the third direction.

As shown in FIG. 14, the mating connector 500 further has a coupling portion 536.

Referring to FIG. 14, the coupling portion 536 is made of conductor and has a flat-plate shape perpendicular to the third direction. The coupling portion 536 couples the mating ground terminals 530 with each other so that the mating ground terminals 530 are integrated with each other. The coupling portion 536 is positioned between the contact point 532 and the fixed portion 538 in the first direction. As shown in FIG. 12, a part of the coupling portion 536 is held by the bottom portion 507.

As described above, the mating connector 500 of the present embodiment has the coupling portion 536 which couples the mating ground terminals 530 with each other. Accordingly, the mating ground terminals 530 are commonly grounded and resistance to ground potential is reduced.

Figure 2:
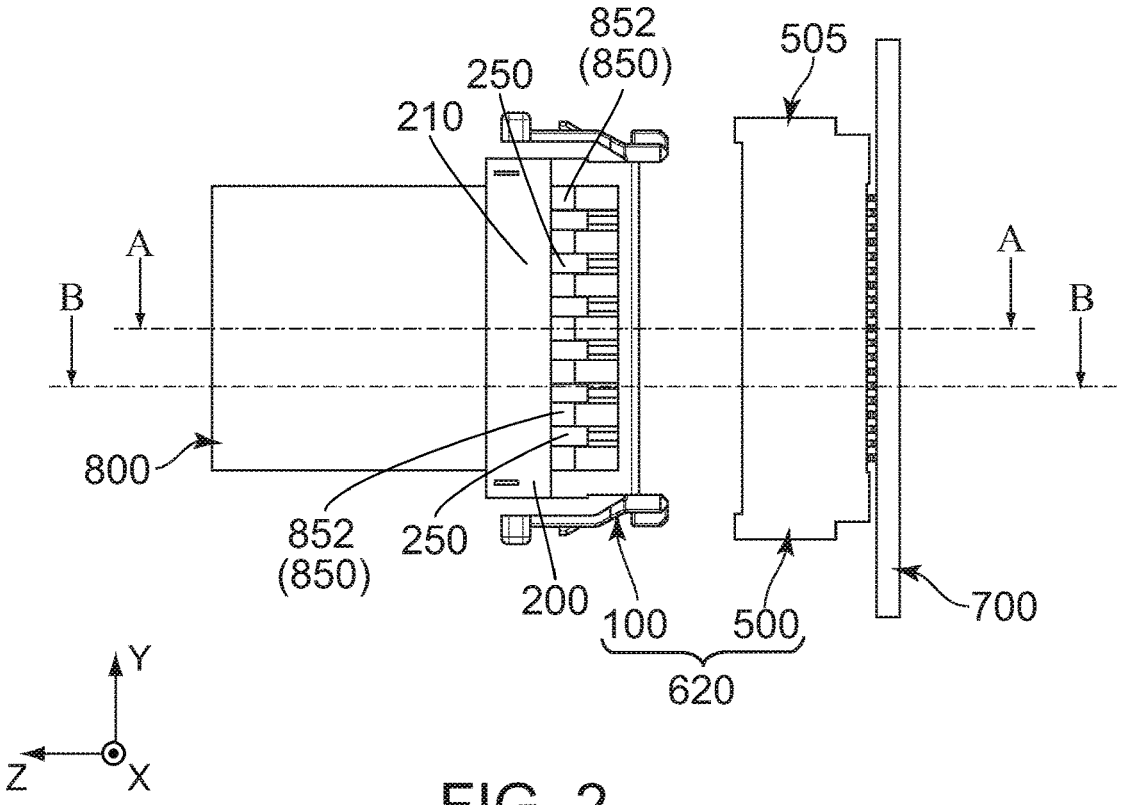
FIG. 2 is a front view showing the connector assembly of FIG. 1.

As shown in FIG. 1, the harness 600 of the present embodiment comprises two connecting objects 800 and a connector 100. In other words, the connector assembly 650 of the present embodiment comprises the mating connector 500, the two connecting objects 800 and the connector 100. Referring to FIG. 2, the mating connector 500 and the connector 100 form a connector assembly 620. In other words, the connector assembly 620 comprises the connector 100 and the mating connector 500.

Figure 17:
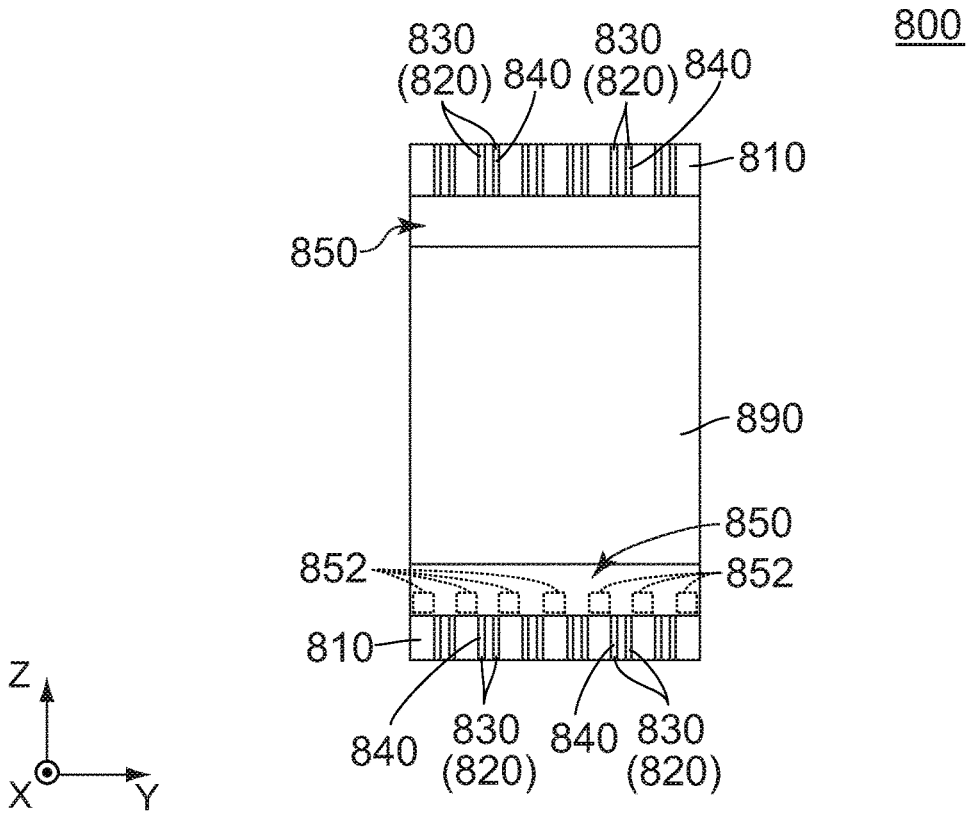
FIG. 17 is a view showing the connecting object which is included in the connector assembly of FIG. 1.
Figure 18:
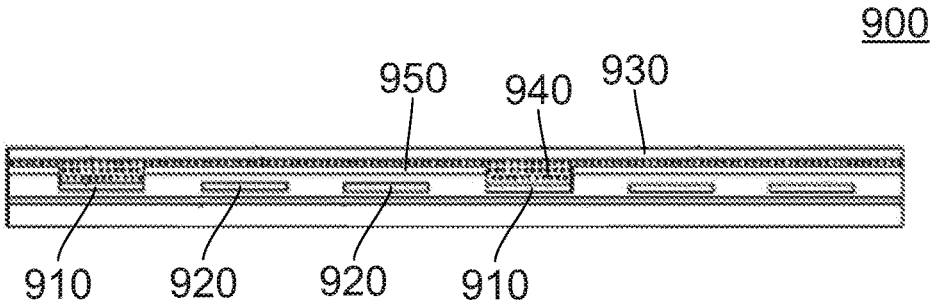
FIG. 18 PRIOR ART
FIG. 18 is a cross-sectional view showing an FFC of Patent Document 1.

Referring to FIG. 17, the connecting object 800 of the present embodiment is used for connection to a device such as an electronic equipment. In detail, the connecting object 800 is used for connection to a device having at least two ground pins and at least one signal pin which is arranged between two of the ground pins in a pitch direction. Specifically, the connecting object 800 is used for connection to a device which is provided with the mating connector 500, wherein: the ground pin is the mating ground terminal 530; the signal pin is the mating signal terminal 510; and the pitch direction is the Y-direction.

Referring to FIGS. 3 and 17, each of the connecting objects 800 has a sheet-like shape. More specifically, each of the connecting objects 800 is a Flexible Flat Cable (FFC). However, the present invention is not limited thereto. The connecting object 800 may be a Flexible Printed Circuit (FPC). The two connecting objects 800 have the same structure as each other. The connecting object 800 is configured to be attached with the connector 100.

Figure 7:
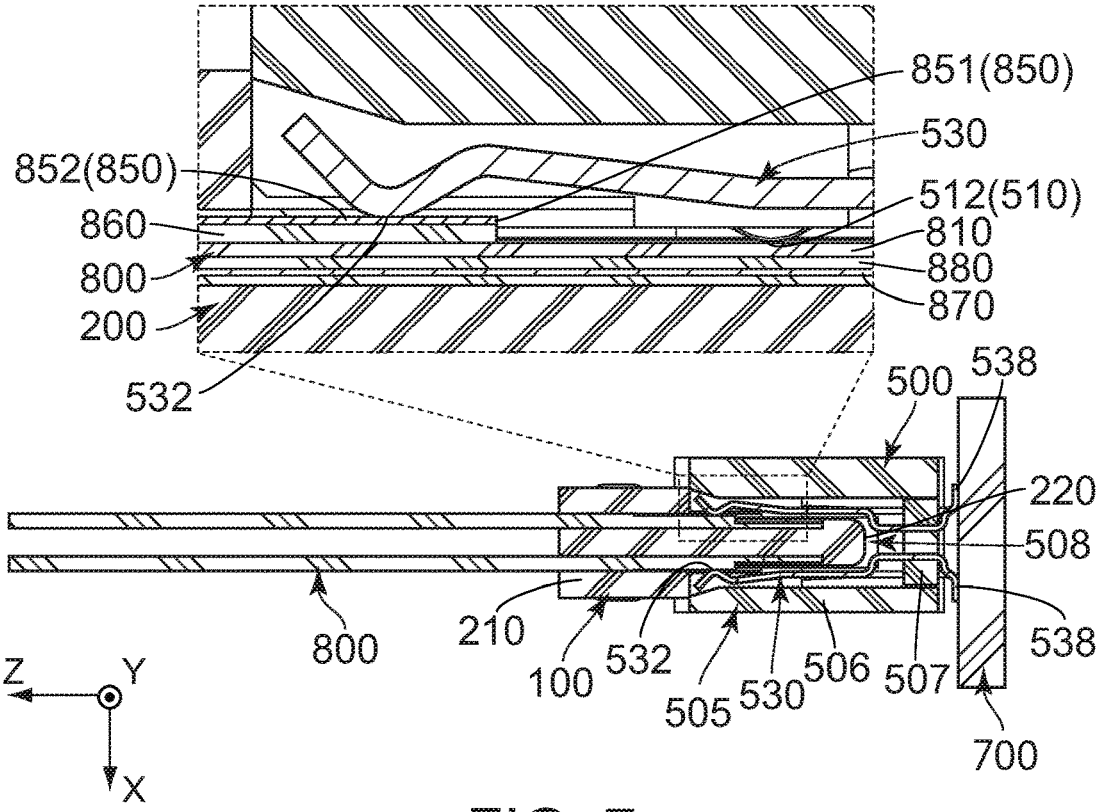
FIG. 7 is a cross-sectional view showing the connector assembly of FIG. 6, taken along line C-C.
Figure 8:
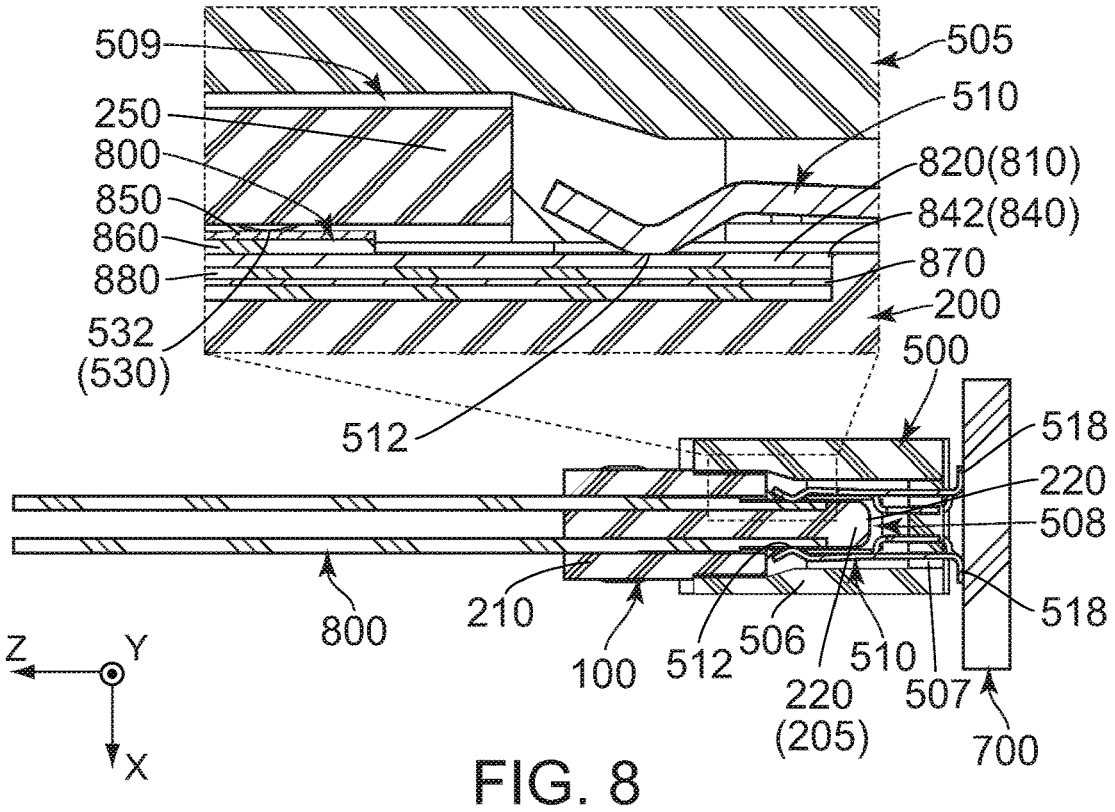
FIG. 8 is a cross-sectional view showing the connector assembly of FIG. 6, taken along line D-D.

Referring to FIGS. 7, 8 and 17, a transmission line of the connecting object 800 is configured as a microstrip transmission line or strip transmission line. Specifically, the connecting object 800 has a wiring layer 810, a shield layer 850, an additional shield layer 870, a first insulator 860, a second insulator 880 and a third insulator 890. In the present application, the shield layer 850 is also referred to as a conductive layer. However, the present invention is not limited thereto. The connecting object 800 may have no additional shield layer 870.

Referring to FIGS. 4 and 17, the wiring layer 810 of the present embodiment extends in a plane perpendicular to the third direction which is perpendicular to both the first direction and the second direction. The wiring layer 810 is positioned between the shield layer 850 and the additional shield layer 870 in the third direction perpendicular to both the first direction and the second direction. More specifically, the wiring layer 810 is positioned between the first insulator 860 and the second insulator 880 in the third direction. The wiring layer 810 includes a plurality of signal lines 820. In the present application, the signal line 820 is also referred to as a trace. However, the present invention is not limited thereto. The wiring layer 810 should include at least one signal line 820. The wiring layer 810 is formed with only the signal lines 820 which are configured to be connected with the signal pins, respectively, of the device. The wiring layer 810 is formed with no ground line which is configured to be connected with the ground pin of the device.

As shown in FIG. 17, the signal lines 820 of the present embodiment include a plurality of differential pairs each consisting of two of the signal lines 820, wherein the two signal lines 820 of the differential pair correspond to the two mating signal terminals 510 which constitutes the differential pair 520. In other words, the signal lines 820 include the differential pairs 830 each consisting of the two signal lines 820, and the differential pairs 830 correspond to the differential pairs 520 (see FIG. 10), respectively, of the mating signal terminals 510. However, the present invention is not limited thereto. The signal lines 820 may include the two signal lines 820 constituting the differential pair 830 or may be lines for single-ended transmission. If the signal lines 820 include the two signal lines 820 constituting the differential pair 830, the mating signal terminals 510 include the two mating signal terminals 510 which correspond to the differential pair 830.

As shown in FIG. 17, each of the signal lines 820 has a signal contact portion 840. In the present application, the signal contact portion 840 is also referred to as a first contact portion. The signal contact portion 840 has an end 842 in the first direction. The end 842 is a lower end of the signal contact portion 840.

As shown in FIG. 17, the signal contact portion 840 of the present embodiment is exposed to the outside of the connecting object 800. More specifically, the signal contact portion 840 is exposed to the outside of the connecting object 800 in the third direction.

As shown in FIG. 8, under a mated state where the connector 100 is mated with the mating connector 500 while being in an attached state where the connector 100 is attached with the connecting object 800, the signal contact portion 840 is brought into contact with the mating signal terminal 510. In detail, the signal contact portion 840 is brought into contact with the contact point 512 of the mating signal terminal 510 under the mated state.

Figure 16:
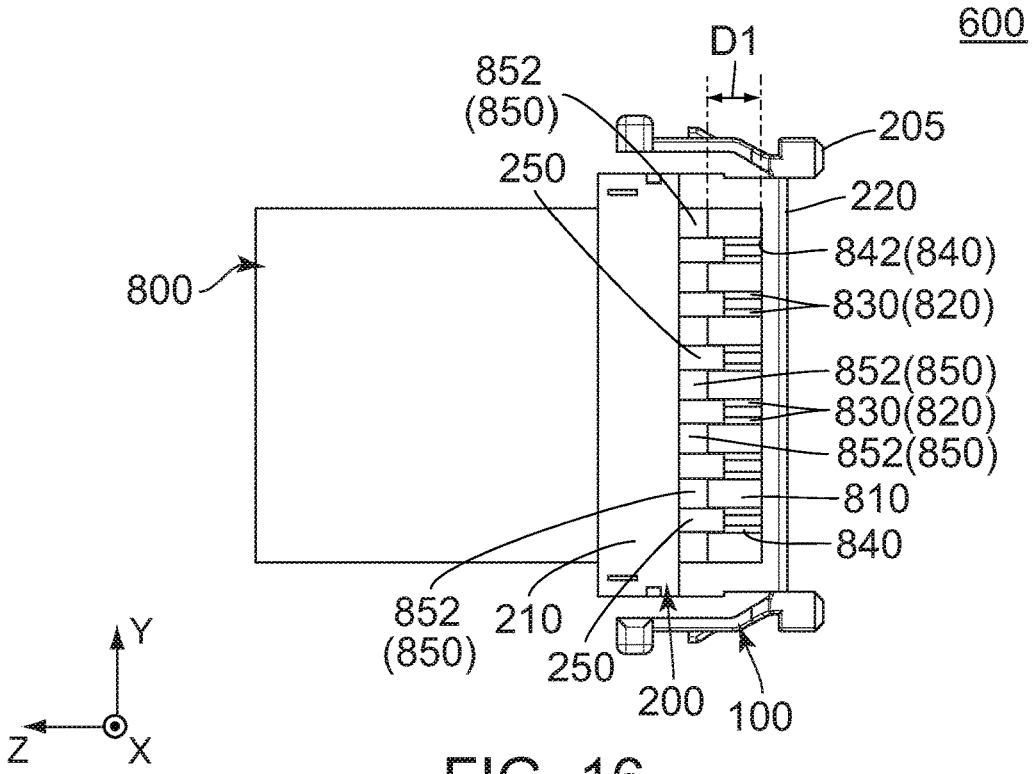
FIG. 16 is a front view showing the harness which is included in the connector assembly of FIG. 1.

Referring to FIGS. 4 and 16, the signal contact portion 840 is positioned between two of the mating ground terminals 530 in the second direction perpendicular to the first direction under the mated state.

As shown in FIGS. 3 and 17, the shield layer 850 of the present embodiment extends in the plane perpendicular to the third direction. As shown in FIG. 3, the shield layer 850 covers the wiring layer 810 via the first insulator 860 which is positioned between the shield layer 850 and the wiring layer 810. The shield layer 850 is positioned outward of the first insulator 860 in the third direction. A part of the shield layer 850 is exposed to the outside of the connecting object 800. More specifically, as shown in FIG. 17, opposite ends of the shield layer 850 in the first direction and their vicinities are exposed to the outside of the connecting object 800. A remaining part of the shield layer 850 is covered by the third insulator 890.

As shown in FIGS. 16 and 17, the shield layer 850 has a plurality of shield contact portions 852. However, the present invention is not limited thereto. The shield layer 850 should have at least two shield contact portions 852. In the present application, the shield contact portion 852 is also referred to as a second contact portion.

As shown in FIG. 17, the wiring layer 810 has areas which correspond to the shield contact portions 852, respectively, in the second direction, and each of the areas of the wiring layer 810 is provided with no conductive member. Each of the shield contact portion 852 and the signal contact portion 840 is exposed to the outside of the connecting object 800. As shown in FIG. 16, each of the shield contact portion 852 and the signal contact portion 840 is exposed to the outside of the holding member 200 under the attached state.

As shown in FIG. 7, the shield contact portions 852 are brought into contact with the mating ground terminals 530, respectively under the mated state. More specifically, the shield contact portions 852 are brought into contact with the contact points 532 of the mating ground terminals 530, respectively, under the mated state.

Referring to FIGS. 4 and 16, in the first direction, a distance D1 from the end 842 of the signal contact portion 840 to the shield contact portion 852 is shorter than a distance D2 from the contact point 512 of the mating signal terminal 510 to the contact point 532 of the mating ground terminal 530. Accordingly, when the connector 100 in the attached state is mated with the mating connector 500, the contact point 532 of the mating ground terminal 530 is brought into contact with shield contact portion 852 before the contact point 512 of the mating signal terminal 510 is brought into contact with the end 842 of the signal contact portion 840. When the connector 100 is removed from the mating connector 500 under the mated state, the contact between the contact point 532 of the mating ground terminal 530 and the shield contact portion 852 is released after the contact between the contact point 512 of the mating signal terminal 510 and the end 842 of the signal contact portion 840 is released. Thus, the connector assembly 620, 650 of the present embodiment is configured so that the connector 100 is mateable with and removable from the mating connector 500 during the connector assembly 620, 650 is powered. In other words, the connector assembly 620, 650 can be used for so-called "hot-plugging".

Referring to FIG. 4, the additional shield layer 870 of the present embodiment extends in the plane perpendicular to the third direction. The additional shield layer 870 covers the wiring layer 810 via the second insulator 880 which is positioned between the additional shield layer 870 and the wiring layer 810. The additional shield layer 870 is positioned inward of the second insulator 880 in the third direction. The additional shield layer 870 is not exposed to the outside of the connecting object 800. The additional shield layer 870 is grounded.

As described above, when the connector 100 in the attached state is mated with the mating connector 500, the signal contact portions 840 are brought into contact with the mating signal terminals 510, respectively, while the shield contact portions 852 are brought into contact with the mating ground terminals 530, respectively. This enables the connector assembly 620, 650 of the present embodiment to be configured so that, under the mated state where the connector 100 is mated with the mating connector 500 while being in the attached state where the connector 100 is attached with the connecting object 800, the mating ground terminals 530 are connected with the shield layer 850 of the connecting object 800 whose transmission line is configured as a microstrip transmission line or strip transmission line. If the connecting object 800 has the additional shield layer 870, the transmission line of the connecting object 800 functions as a strip transmission line. If the connecting object 800 does not have the additional shield layer 870, the transmission line of the connecting object 800 functions as a microstrip transmission line.

Figure 5:
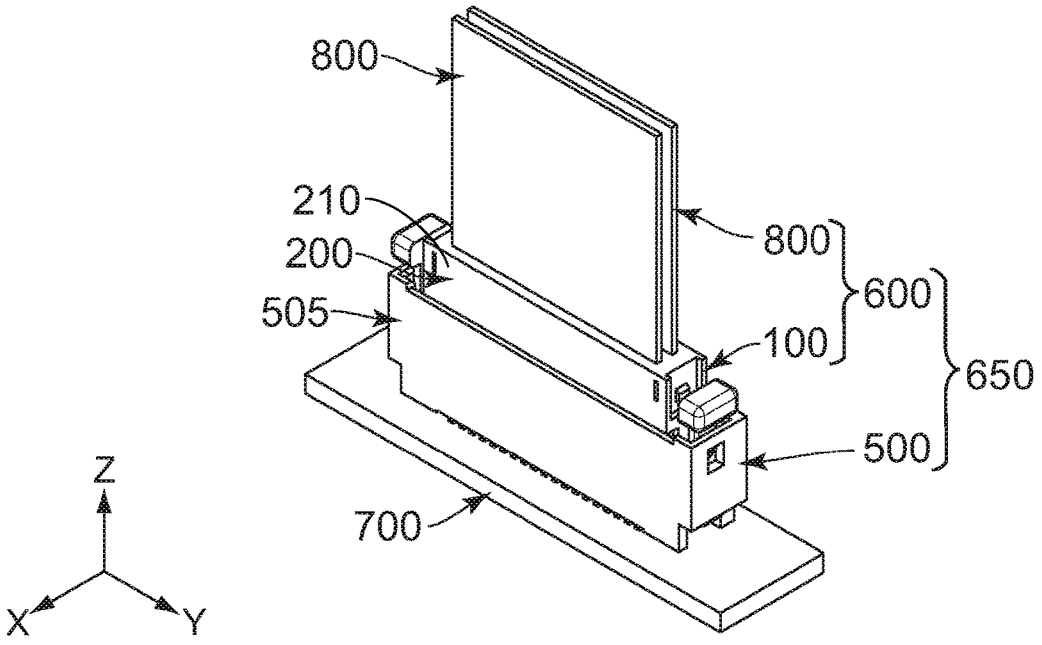
FIG. 5 is another perspective view showing the connector assembly of FIG. 1. In the figure, the connector of the harness is in a mated state where the connector is mated with the mating connector.
Figure 6:
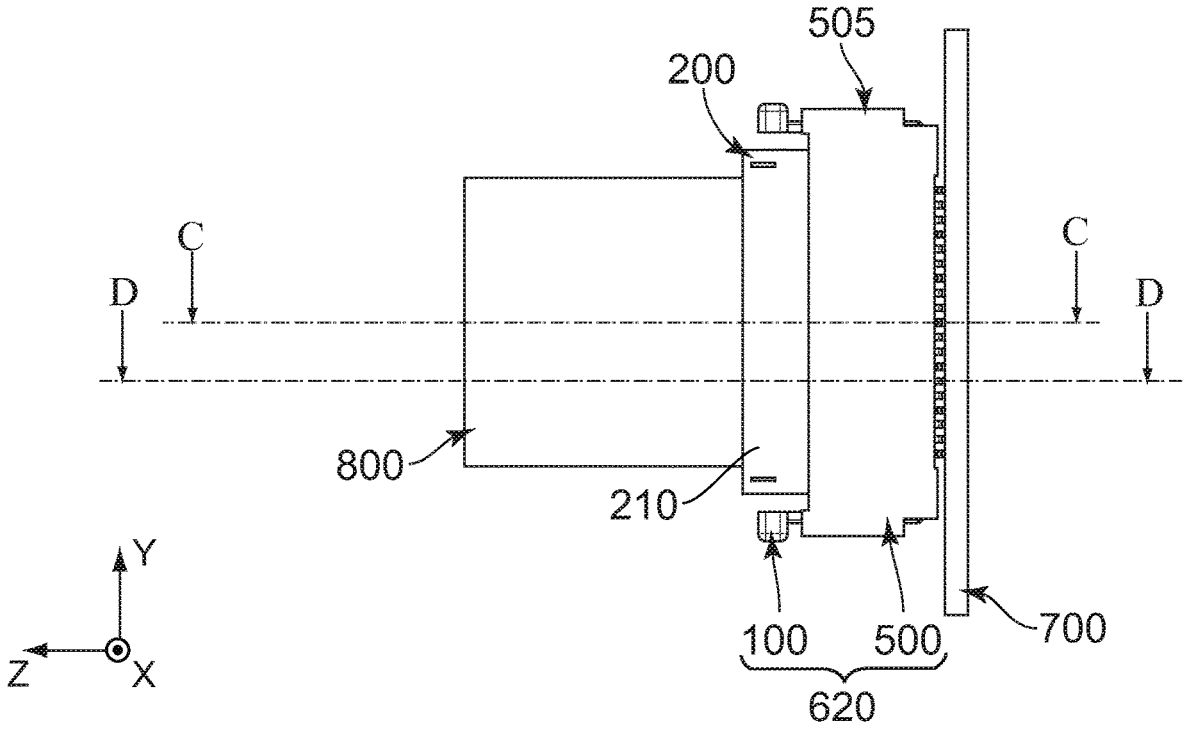
FIG. 6 is a front view showing the connector assembly of FIG. 5.

As shown in FIG. 16, the connector 100 of the present embodiment is configured to be attached with the connecting object 800 having the sheet-like shape. In the harness 600 of the present embodiment, the connector 100 is attached with the connecting objects 800. Referring to FIGS. 1 and 5, the connector 100 is mateable with the mating connector 500 along the first direction.

As shown in FIG. 16, the connector 100 of the present embodiment comprises a holding member 200.

As shown in FIG. 16, the holding member 200 partially holds the connecting object 800.

Referring to FIG. 16, the holding member 200 of the present embodiment is made of insulator. Specifically, the holding member 200 has a mating portion 205, two plate portions 210 and a plurality of cover portions 250.

As shown in FIG. 16, the mating portion 205 of the present embodiment defines a lower end of the connector 100. As shown in FIG. 8, when the connector 100 is mated with the mating connector 500, the mating portion 205 is accommodated in the mating portion accommodating portion 508.

As shown in FIG. 16, the mating portion 205 has a guard portion 220, As shown in FIG. 16, the guard portion 220 of the present embodiment extends in the second direction. The guard portion 220 is positioned below the cover portion 250 in the first direction. The guard portion 220 is positioned below the signal contact portion 840 of the connecting object 800 in the first direction under the attached state.

Referring to FIGS. 3 and 16, each of the plate portions 210 of the present embodiment has a flat-plate shape perpendicular to the third direction. The plate portions 210 are positioned at opposite ends, respectively, of the holding member 200 in the third direction. An upper end of the plate portion 210 is an upper end of the connector 100.

As shown in FIGS. 3 and 16, each of the cover portions 250 has a cuboid shape extending in the first direction. Each of the cover portions 250 extends downward in the first direction from the plate portion 210. As shown in FIG. 4, each of the cover portions 250 covers the signal lines 820 of the connecting object 800 under the attached state. In other words, the holding member 200 is provided with the cover portions 250 which cover the signal lines 820. However, the present invention is not limited thereto. The holding member 200 should be provided with the cover portion 250 which covers at least one of the signal lines 820. As shown in FIG. 8, the cover portions 250 are accommodated in the cover portion accommodating portions 509, respectively, of the holding member 200 under the mated state.

As described above, the holding member 200 of the present embodiment is provided with the cover portions 250 which cover the signal lines 820. Accordingly, the connector assembly 620, 650 of the present embodiment can prevent a part of the transmission line around the signal contact portion 840 from having an increased impedance as compared with an assumption where the connector assembly 620, 650 have no cover portion 250. Thus, the connector assembly 620, 650 of the present embodiment can prevent an impedance mismatch in the transmission line of the connecting object 800 as compared with the above-mentioned assumption.

As shown in FIG. 4, each of the cover portions 250 is positioned outward of the connecting object 800 in the third direction under the attached state. Each of the cover portions 250 covers a part of the connecting object 800 under the attached state. Each of the cover portions 250 is not in contact with the connecting object 800 in the third direction under the attached state. A lower end of each of the cover portions 250 is positioned above a lower end of the connecting object 800 in the first direction under the attached state. Each of the cover portions 250 is positioned outward of the shield layer 850 in the third direction under the attached state. Each of the cover portions 250 covers a part of the shield layer 850 under the attached state. Each of the cover portions 250 is not in contact with the shield layer 850 in the third direction under the attached state. The lower end of each of the cover portions 250 is positioned below a lower end 851 of the shield layer 850 in the first direction under the attached state. Each of the cover portions 250 is positioned outward of the signal line 820 of the connecting object 800 in the third direction under the attached state. Referring to FIG. 16, the cover portions 250 correspond to the differential pairs 830, respectively. Under the attached state, each of the cover portions 250 is positioned outward of the two signal lines 820, which constitutes the differential pair 830 corresponding thereto, in the third direction. Under the attached state, each of the cover portions 250 covers the two signal lines 820 constituting the differential pair 830 corresponding thereto. The lower end of the cover portion 250 is positioned above the end 842 of the signal contact portion 840 in the first direction under the attached state. As shown in FIG. 16, the cover portion 250 is positioned between two of the shield contact portions 852 in the second direction under the attached state.

As shown in FIG. 8, the cover portion 250 is positioned apart from the mating signal terminal 510 in the first direction under the mated state. Specifically, the cover portion 250 is not in contact with the mating signal terminal 510 in the first direction under the mated state.

Referring to FIGS. 4 and 16, the cover portion 250 is positioned between two of the mating ground terminals 530 in the second direction under the mated state. The cover portion 250 is not in contact with the mating ground terminal 530 in the second direction under the mated state.

Although the specific explanation about the present invention is made above referring to the embodiments, the present invention is not limited thereto and is susceptible to various modifications and alternative forms.

Although the mating connector 500 of the present embodiment is the straight connector so that the connector 100 is mateable with the mating connector 500 along the first direction, or along the up-down direction perpendicular to the circuit board 700, the present invention is not limited thereto. Specifically, the mating connector 500 may be a right angle connector so that the connector 100 is mateable with the mating connector 500 along a front-rear direction parallel to the circuit board 700. In other words, the first direction may be the front-rear direction.

In the present embodiment, the mating signal terminals 510 and the mating ground terminals 530 are arranged in the two rows, and the mating signal terminals 510 and the mating ground terminals 530 of each of the two rows are arranged in the second direction. However, the present invention is not limited thereto. Specifically, the mating signal terminals 510 and the mating ground terminals 530 may be arranged in one row or arranged in three or more rows.

Although the specific explanation about the present invention is made above referring to the embodiments, the present invention is not limited thereto and is susceptible to various modifications and alternative forms.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a connecting object, a connector and a mating connector, the connecting object having a sheet-like shape, wherein:

the connecting object has a wiring layer, a shield layer and a first insulator;

the wiring layer includes at least one signal line;

the signal line has a signal contact portion;

the shield layer covers the wiring layer via the first insulator which is positioned between the shield layer and the wiring layer;

the shield layer has at least two shield contact portions;

each of the shield contact portions and the signal contact portion is exposed outside the connecting object;

the connector is attached with the connecting object;

the connector is mateable with the mating connector along a first direction;

the connector comprises a holding member;

the holding member partially holds the connecting object;

the mating connector comprises at least one mating signal terminal and at least two mating ground terminals;

the signal contact portion is positioned between two of the mating ground terminals in a second direction perpendicular to the first direction under a mated stare where the connector is mated with the mating connector;

the signal contact portion is brought into contact with the mating signal terminal under the mated state; and the shield contact portions are brought into contact with the mating ground terminals, respectively, under the mated state.

2. The connector assembly as recited in claim 1, wherein:

the mating connector has a coupling portion;

the coupling portion is made of conductor; and the coupling portion couples the mating ground terminals with each other so that the mating ground terminals are integrated with each other.

3. The connector assembly as recited in claim 1, wherein:

the connecting object with the sheet-like shape has an additional shield layer and a second insulator;

the additional shield layer covers the wiring layer via the second insulator which is positioned between the additional shield layer and the wiring layer; and the wiring layer is positioned between the shield layer and the additional shield layer in a third direction perpendicular to both the first direction and the second direction.

4. The connector assembly as recited in claim 1, wherein:

the at least one signal line includes two of the signal lines which constitute a differential pair; and the at least one mating signal terminal includes two of the mating signal terminals which correspond to the differential pair.

5. The connector assembly as recited in claim 1, wherein:

the wiring layer has an area which corresponds to the shield contact portion in the second direction; and the area of the wiring layer is provided with no conductive member.

6. The connector assembly as recited in claim 1, wherein the connecting object is a Flexible Flat Cable (FFC).

7. The connector assembly as recited in claim 1, wherein:

the holding member is provided with a cover portion which covers the at least one signal line; and the cover portion is positioned between two of the shield contact portions in the second direction.

8. The connector assembly as recited in claim 1, wherein:

the signal contact portion has an end in the first direction;

the connecting object has a first distance from the end of the signal contact portion to the shield contact portion in the first direction;

the mating signal terminal has a contact point;

the mating ground terminal has a contact point;

the mating connector has a second distance from the contact point of the mating signal terminal to the contact point of the mating ground terminal in the first direction; and the first distance is shorter than the second distance.

9. A connector assembly comprising a connector and a mating connector, the connector being attachable with a connecting object having a sheet-like shape, wherein:

the connecting object has a wiring layer, a conductive layer and an insulator;

the wiring layer includes at least one trace;

the trace has a first contact portion;

the conductive layer covers the wiring layer via the insulator which is positioned between the conductive layer and the wiring layer;

the conductive layer has at least two second contact portions;

the connector is mateable with the mating connector along a first direction;

the connector comprises a holding member;

the holding member partially holds the connecting object under an attached state where the connector is attached with the connecting object;

each of the first contact portion and the second contact portions is exposed outside the holding member under the attached state;

the mating connector comprises at least one mating first terminal and at least two mating second terminals;

under a mated state where the connector in the attached state is mated with the mating connector, the first contact portion is positioned between two of the mating second terminals in a second direction perpendicular to the first direction;

the first contact portion is brought into contact with the mating first terminal under the mated state; and the second contact portions are brought into contact with the mating second terminals, respectively, under the mated state.

* * * * *